United States Patent [19]

McCoy

[11] 4,150,852

[45] Apr. 24, 1979

[54] METHOD OF STRIP MINING

[76] Inventor: Charles M. McCoy, P.O. Box 467, Prestonsburg, Ky. 41653

[21] Appl. No.: 798,134

[22] Filed: May 18, 1977

[51] Int. Cl.[2] ..... E21C 41/04

[52] U.S. Cl. ..... 299/18; 299/19

[58] Field of Search ..... 299/18, 19; 37/195

[56] References Cited

U.S. PATENT DOCUMENTS

| | | | |
|---|---|---|---|
| 1,244,203 | 10/1917 | Hawkesworth | 299/19 |
| 2,948,520 | 8/1960 | Densmore | 299/55 |
| 3,975,053 | 8/1976 | Kochanowsky | 299/18 |
| 4,017,122 | 4/1977 | Simpson | 299/18 |

OTHER PUBLICATIONS

*Mining Engineering Hndbk.*, Robert Peele, et al., 3rd Edition, 1941, John Wiley and Sons, pp. 464–469.

Portable Crushers for Open Pit and Quarry Operations, B. J. Kochanowsky, Mining Engineering, Dec., 1960, pp. 1271–1274.

*Primary Examiner*—William Pate, III

*Attorney, Agent, or Firm*—Shoemaker and Mattare, Ltd.

[57] ABSTRACT

A strip mining technique wherein an active mining area is continuously moved across a mining ground. Overburden is removed from a leading end of the active mining area and conveyed by a conveyor system located on a high-wall of the mining area to a following end of that mining area. The conveyed overburden is dumped adjacent the active mining area following end to form a spoil bank which is landscaped and reclaimed.

11 Claims, 2 Drawing Figures

METHOD OF STRIP MINING

BACKGROUND OF THE INVENTION

The present invention relates to mining methods, and more particularly, to strip mining methods.

In recent times, strip mine operators have been placed under considerable pressure from two sides. Energy users, on one side, pressure the strip miners to produce more coal, while environmentalists, on the other side, pressure strip miners to leave the environment undamaged. Recently, there have been many moves begun to completely eliminate strip mining unless methods can be devised which leave the mined terrain undamaged and nearly unchanged after completion of a strip mining operation.

Accordingly, strip mining methods must be devised which will satisfy both sides of the strip mining argument. Those strip mining methods must be able to produce large quantities of coal quickly, but must not deface the terrain or mar the beauty of the land.

A further constraint often placed on strip miners arises because a mining lease under which the miners are operating extends for only a short distance. In short leases, economics becomes an important factor. Thus, any new strip mining method should be adaptable to shortwall mining activities, as well as to long unbroken mining leases.

There are several mining methods known. These methods include benches which rotate about a turning-point area in a downwardly spiralling path, and cross-ridge techniques whereby an entire mountain top is ultimately removed.

The known mining methods suffer several drawbacks, among them being the drawbacks caused by the location of the haulage systems in positions which interfere with other machinery used in the operation. Furthermore, the known systems, especially those just-mentioned systems, remove earth in such a manner as to make land reclamation difficult, if not impossible. In fact, the cross-ridge technique, by its very purpose, makes restoring the land to its original layout impossible. The environment, especially that environment affecting wildlife, is therefore severely disrupted by such known techniques.

It is for these reasons, among others, that known strip mining techniques have not met with wide acceptance, either from public groups, or from the strip miners themselves.

The strip mining method embodying the teachings of the present invention solves the above-discussed problems, while providing a mining technique economically adaptable to any terrain layout or mining lease extent. The mining technique embodying the teachings of the present invention should, therefore, find acceptance by both public groups and the strip miners themselves.

SUMMARY OF THE INVENTION

The mining technique embodying the teachings of the present invention maintains the overburden haulage system out of the way of other machinery and is adaptable to any size and shape working area.

The technique utilizes a plurality of terraces, or benches, one of which supports trucks, shovels and other earth moving equipment, and at least one of which supports lateral conveyors of an overburden conveying system. The lateral conveyors are located on the highwall and convey overburden removed from one end of the active mining area to the other end thereof. The overburden is dumped by the conveyor system on the rear end of the active mining area to form a spoil bank which is landscaped and otherwise reclaimed as the mining progresses.

Coal removing means, such as a coal auger, removes coal from the coal bank and transports that removed coal onto further haulage systems which move that coal into haulage trucks, or the like, to be transported via an access road to appropriate locations. As the mining progresses, the coal removing means moves across, or along, a coal seam, depending on which direction the active mining area is moving with respect to the coal seam.

The mining method embodying the teachings of the present invention therefore continuously removes overburden from one end of the active mining area while simultaneously dumping overburden on the other end of the active mining area by conveying that overburden along a conveyor system located on the highwall out of the way of other work machines. Coal removing equipment is located in the active mining area and removes coal while the just-mentioned overburden haulage occurs.

The active mining area itself thus is continuously moved across or along a mining ground and is self-contained. The conveyors are movable and move along with the other mining equipment. The active mining area can be of any length or configuration, depending upon the layout of the mining ground, can move either laterally or across a ridge, and is therefore amenable to a wide variety of mining operations. As the earth moving equipment removing the overburden from the leading edge of the active mining area advances, all of the other systems, such as the conveyor systems, the coal removing machinery and other haulage equipment, advance, and the overburden is dumped into a spoil bank at the rear edge of the active mining area. The active mining area thus moves across a mining ground from one mining lease boundary to the other until the mining ground encompassed by that lease is covered.

The conveyor system utilized in this process is located and operated on the highwall and thus does not interfere with any other machinery used in the operation. Thus, the conveyor system not only ceases to be a problem, but actually assists in the reclamation step of the mining operation.

Spoil from the spoil bank will not spill down a mountainside, as that spoil is supported by the lower bench. Supporting means, such as berms or the like, can also be provided to further assist in the prevention of spillage. Thus, streams will not be contaminated and the land will not have unsightly scars. Regrowth of vegetation and timber is promoted by the subject mining technique, and thus wildlife activities will not be as severely interrupted as they are with present strip mining techniques.

OBJECTS OF THE INVENTION

It is, therefore, a main object of the present invention to provide a strip mining method which efficiently mines an area without substantially affecting the terrain.

It is another object of the present invention to provide a strip mining method which includes an overburden conveyor system which does not interfere with other machinery.

It is a further object of the present invention to provide a strip mining method which can be used in shortwall mining operations.

It is yet another object of the present invention to provide a strip mining method which facilitates land reclamation.

It is yet a further object of the present invention to provide a strip mining method which can be used on a wide variety of mining ground topographies and extents.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
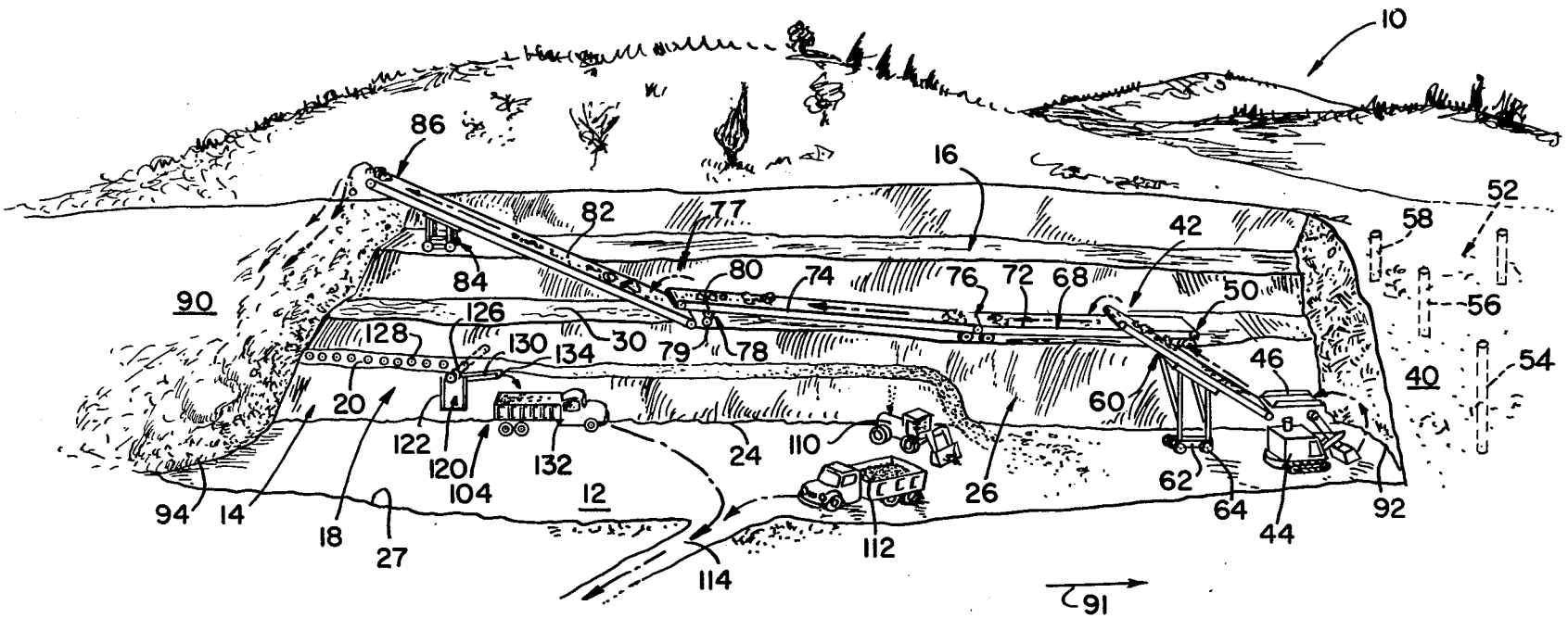
FIG. 1 is an elevation view of an active mining area showing the layout of the mining equipment used in the mining technique embodied by the teachings of the present invention.

Shown in FIG. 1 is a portion of a mining ground 10 located in a mountain ridge or the like. Mining is conducted to remove coal with only minor alterations in the overall aesthetic appearance of the mined area.

As shown in FIG. 1, an active mining area comprises a lowermost, or first, ledge or bench 12 abutting a highwall 14 which has one or more further benches or offsets, such as bench 16, defined therein. As shown in FIG. 1, the mining area can have a coal seam 18, and coal bank 20 is therefore located in the highwall and intersects bench 12 at bench edge 24 and contains coal face 26 therein. The coal seam lies at the base of the highwall and extends to a location adjacent the outer edge 27 of the bench 12. Depending on the nature of the terrain and the coal, the location of the outer edge of the coal seam can be located within ten feet of edge 27. Thus, for example, if bench 12 is sixty feet wide as measured between edges 24 and 27, the coal covers approximately fifty feet of that width when overburden is removed therefrom.

The coal seams can be of various thicknesses as well and the thickness indicated in FIG. 1 is merely an example.

Figure 2:
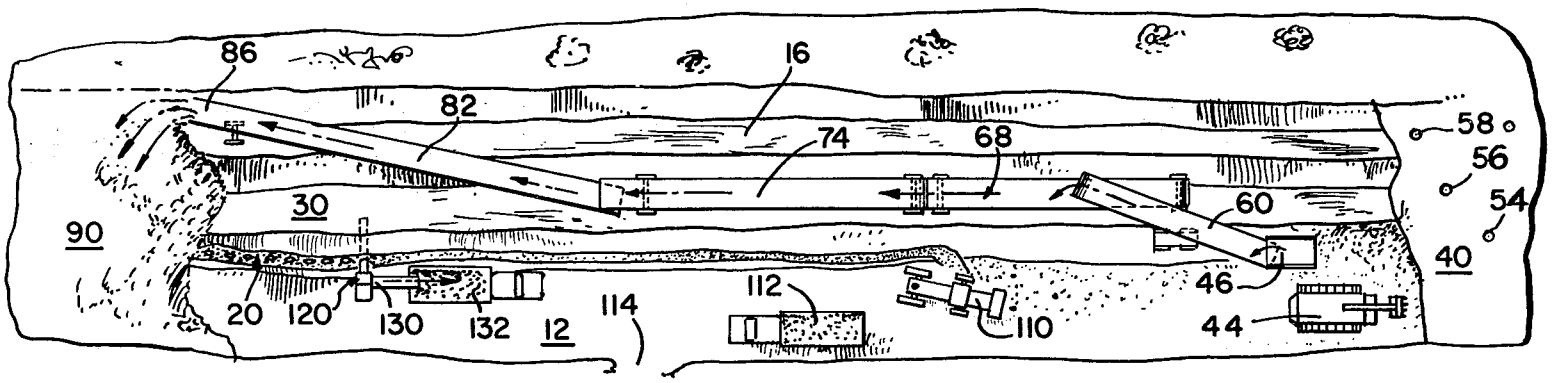
FIG. 2 is a plan view of the active mining area shown in FIG. 1.

One of the further benches can be defined by overcut 30. The mining area is generally located on a side or ridge of a mountain, and the slope of the mountain is indicated in FIG. 2 by the offset nature of the benches.

Overburden 40 is removed from one end of the active mining area by a haulage system 42 which includes a power shovel 44 which loads overburden into a feeder chute 46 leading to an overburden haulage conveyor system 50. Shovel 44 is shown in FIG. 1 to be resting on top of the coal in the coal seam, and the shovel 44 travels on top of that coal as it removes rock and dirt from off of that coal. A plurality of blasting bore holes 52 are located in the overburden 40 in advance of the shovel 44. The holes 52 are used in blasting operations to loosen the dirt and rock prior to removal thereof by the shovel 44. The depth of the bore holes 52 can be varied to accommodate the benches. Thus the length of the holes as measured from the top of the mountain is set to define the distance of the various benches down the highwall. Thus, bore holes 54 define bench 12, bore holes 56 define overcut 30, and bore holes 58 define bench 16, and so on for each bench. The spacing between the bore holes is determined by the terrain, rock formation, and the like.

The haulage conveyor system comprises an upwardly inclined feeding, or loading, conveyor 60 movably mounted on bench 12 by a movable mounting base 62 which has wheels 64 and connects the feeder 46 to a lateral conveyor section 68 which moves the overburden across the active mining area on the highwall, and which includes a plurality of conveyors, such as aligned endless belt type conveyors 72 and 74 coupled together at adjacent ends thereof by a coupling member 76 or via overlapping and dropping material onto the next conveyor as shown at position 77. The lateral conveyor section 68 is mounted on one of the benches 16 or on overcut 30, depending on the setup of the active mining area, and is laterally movable to accommodate various setups for the lateral conveyor system.

The lateral conveyor system can include one or more conveyors which are linearly aligned or skewed with respect to each other, depending upon the lay of the land. For example, if the highwall is slightly convex, the conveyors forming the lateral conveyor section will be slightly articulated or misaligned to accommodate such highwall shape. The conveyor coupling members can include pivots, spindles, or the like so that the conveyors can be arranged to produce the articulation or misalignment necessary to accommodate the shape of the highwall. The coupling members, themselves, may be curved conveyors, or simply walled transfer plates, or the like. The conveyors at position 77 will be in overlapping arrangement so that material is dropped from one conveyor to the next. As shown in FIG. 1, base members 78 mount the conveyors on the benches and can be movable as well as elevatable. Thus, inclination of the benches can be accommodated by raising appropriate ends of the conveyors, as shown in FIG. 1, to properly incline one or more of the conveyors. The base members can also include wheel 79 or wheel mounts 80, as shown.

The overburden haulage conveyor system further includes a second inclined conveyor 82 communicating at one end thereof with the exit end of one of the lateral conveyors to receive overburden therefrom. The second inclined conveyor is mounted at one end thereof adjacent the lateral conveyor and at the other end thereof on one of the benches 16 by a conveyor mounting base 84. The mounting base 84, like the mounting base 62, is movable and elevatable. A further coupling member can also be used to couple conveyor 82 to the lateral conveyors. Free end 86 of the second inclined conveyor is located on the other end of the inclined conveyor 82, and overburden transferred to the conveyor 82 is dumped off of the free end 86 to form spoil bank 90.

The work dirction is indicated by arrow 91 in FIG. 1, with the leading end of the active mining area being denoted by the numeral 92, and the following end by the numeral 94. The spoil bank is located behind the active working area adjacent following the end 94. Overburden spills down from conveyor free end 86 located at the top of the highwall and spills down onto the lowermost bench 12, thus covering the mined out area and filling the area back to the original terrain contour from the top of the cut to the front edge of the lowermost bench. Berms or the like can be defined in the bench 12 to maintain the spoil bank in position, until and while suitable landscaping operations are performed thereon if needed.

It is therefore seen that the overburden is removed from in front of the active mining area and transferred behind that area to cover the area just mined in a continuous manner. The mining operation thus continuously moves along, or across, the mining ground from one boundary to another boundary of the area encompassed by the mining lease. Preferably, work progresses parallel to a ridge; however, the method of the present disclosure can be adapted to cross-ridge mining operations as well. The haulage system is primarily located on the highwall out of the way of the mining operation, and therefore mining can be conducted in an efficient and economical manner.

While conveyors are preferred, other haulage machines can be used without departing from the teachings of the present invention.

Coal bank 20 is exposed from coal face 26 by a haulage system 104 which includes a front end loader 110 located on the bench 12 and haulage trucks, such as truck 112, into which earth is dumped. The coal is picked up by loader 110 which follows shovel 44 as that shovel uncovers the coal. The trucks 112 move onto and off of the bench 12 via an access road 114 and deliver coal to a tipple or a railway loading point, or the like. The end loaders can move either overburden, coal, or a combination thereof. Of course, several front-end loaders can be used to move overburden, coal, or a combination thereof, as desired, along with other suitable earth moving equipment. The single front-end loader and truck are illustrated in FIG. 1 for the sake of convenience and are not intended to be limited. Furthermore, several power shovels, or other suitable machines, can be employed.

As shown in FIG. 1, coal is removed from the coal bank by coal removing machinery, such as a coal auger 120, which includes a movable base 122 preferably mounted on the bench 12 to be elevatable. An auger 126 is mounted on the base to extend horizontally into the coal seam to extract coal therefrom by boring holes, such as bore hole 128, thereinto. The coal removed by the auger 126 is dumped onto a chute 130 mounted on the base 122 to have one end thereof adjacent the auger to receive coal therefrom. Haulage trucks, such as truck 132, are positioned subjacent free end 134 of the chute 130 to receive coal therefrom. The trucks then haul the coal to suitable positions for further processing, or the like. While an auger is preferred, other coal removal machines can be used without departing from the teachings of the present invention. The auger 120 follows the loader 110 in removing coal from the coal seam, and uses auger bitts determined according to the thickness of the coal seam. Depending on the nature of the coal, the coal is bored out of the mountain in various depths. The auger thus removes additional coal from the seam. Thus, after a coal slab has been taken, further coal is removed by the auger, and by using the process embodying the teachings of the present invention, recovery of coal in high tonnage amounts at rapid rates is possible.

As seen in FIGS. 1 and 2, the overall depth of the active mining area is not great and great amounts of earth are not completely removed from the area. Thus, when the overburden is replaced, great land scars will not occur, even once the overburden settles. Thus, land reclamation is expeditious and complete. As the conveyor system is located on the highwall, the benches need not be as wide as they are in mining operations using prior techniques, as there is no need to make the benches wide enough to accommodate both the overburden haulage system and the earth moving machinery. The benches need only be wide enough to accommodate the earth moving machinery. Thus, land reclamation is easier and more complete using the presently disclosed technique than in prior techniques.

The mining operation embodied by the teachings of the present invention therefore includes defining an active mining area, then removing overburden to define two or more benches to be positioned one above the other in a highwall of the mining area. The operation further includes steps of exposing a coal seam by removing overburden from one end of the active mining area and dumping that overburden into a spoil dump located on the other end of the active mining area, while overburden is simultaneously and continuously being removed from one end of the active mining area. The method also includes removing coal from a coal seam exposed in the highwall and hauling that coal from the mining area while the overburden is being moved from one side of the area to the other. The process is continuous and advances the active mining area completely across a mining ground from one boundary of the lease to another, or to the end of the operation. The operation can thus be continued for a short distance or for several miles, depending upon the extent of the mining lease and the shape of that lease.

The active mining area can be any suitable length and is therefore amenable to usual operations as well as to shortwall mining operations. The number and orientation of the conveyors can be selected to produce the overburden haulage system most suitable for the particular mining operation. Therefore, any topography or mining layout can be accommodated using the mining method disclosed herein.

Landscaping of the spoil bank can be performed while the mining operation is progressing and thus the land is restored and reclaimed rapidly, so that once the mining operation is completed, the aesthetic appearance of the land is quickly restored.

By raising, lowering or otherwise orienting the inclined conveyors and by suitably orienting the lateral conveyors, any highwall height or shape can be accommodated. While three benches have been shown in FIGS. 1 and 2, any number of benches can be used.

The sections of the lateral conveyor system can be 30 feet, 40 feet, or more, so that the curve of the ridge can be accommodated, and bench 12 can be 60 feet wide with the coal auger being located some 150 feet behind the access road in FIG. 1. Certainly, other dimensions can be used, and will occur as the active mining area moves, and the just-mentioned dimensions are intended to be illustratives only and are not intended to be limiting. In fact, the access road may be shifted from adjacent the leading edge of the active mining area to adjacent the following edge thereof, as the mining area is moved. Therefore, various access roads, and spurs, can be defined to accommodate the active working area as it moves completely throughout the track thereof.

Coal seams having a thickness anywhere from a few feet to many hundreds, and even thousands, of feet can be worked using the techniques of the present invention. Even seams of varying thickness can be worked with this technique.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A method of strip mining comprising the steps of:

defining an elongate active mining area in a mining ground, said active mining area including a longitudinal axis, a leading end at one end of said longitudinal axis, a following end at the other end of said longitudinal axis, and a highwall intersecting said ends;

defining a plurality of benches in said active mining area, one of which forms a lowermost bench for supporting earth moving machinery and the other benches being located in said highwall to form a plurality of benches in said highwall above said lowermost bench;

positioning earth moving machinery on said lowermost bench;

continuously removing overburden from adjacent said leading end;

continuously transferring said removed overburden along said longitudinal axis on an overburden removal path which is located in said highwall benches, and which is spaced above said lowermost bench and which is located substantially parallel to said longitudinal axis to a rear location behind said following end, said overburden removal path being spaced apart and above said lowermost bench to be located so that the removed overburden moving in said overburden removal path and equipment used to move that removed overburden in that path does not interfere with the earth moving machinery located on said lowermost bench;

elevating that removed overburden which is located in said overburden removal path adjacent said active mining area following end from said overburden removal path in said highwall benches to a position adjacent the top of said highwall;

covering the mining area behind said following end by spilling said removed and elevated overburden over the highwall onto said lowermost bench;

depositing said spilled overburden into a spoil bank located immediately behind said following end;

shaping said spoil bank to match the contour of the mining ground adjacent said active mining area;

continuously removing coal from said active mining area while said overburden is being moved from adjacent said leading end to said rear end, said active mining area along with said overburden removal path being continously moved in the direction of said longitudinal axis across a mining ground by said continous overburden removing and transferring steps; and continuously shaping said spoil bank whereby the contour of the land is continuously restored behind the moving active mining area as the active mining area moves across the mining ground.

2. The method of strip mining defined in claim 1, wherein the step of locating an overburden conveyor on one of said benches includes a step of orienting the conveyor to accommodate surface curvature in the highwall.

3. The method of strip mining defined in claim 1, wherein the step of removing coal includes a step of removing coal from said highwall.

4. The method of strip mining defined in claim 3, wherein the step of removing coal further includes the use of a coal auger which moves coal onto a truck.

5. The method of strip mining defined in claim 1, further including a step of defining an access road to said active mining area.

6. The method of strip mining defined in claim 1, wherein the step of defining a plurality of benches includes a step of defining three benches.

7. The method of strip mining defined in claim 6, further including removing coal from a coal face located adjacent said lowermost bank.

8. The method of strip mining defined in claim 1, wherein the step of moving overburden onto said overburden conveyor system includes steps of locating said conveyor system on an upper bench above said lowermost bench, moving said overburden onto a feeder chute and then onto a loading conveyor which is upwardly inclined and extends from said feeder chute to said conveyor system.

9. The method of strip mining defined in claim 8, further including a step of elevating said loading conveyor to accommodate varying heights between said upper bench and said lowermost bench.

10. The method of strip mining defined in claim 8, further including a step of moving said overburden onto an upwardly inclined unloading conveyor.

11. The method of strip mining defined in claim 10, further including a step of elevating said unloading conveyor to accommodate various highwall heights, said overburden being unloaded adjacent the top of said highwall so that the mining area adjacent said following end is completely covered with overburden.

* * * * *